US005415614A

United States Patent [19]

Nattrass

[11] Patent Number: 5,415,614

[45] Date of Patent: May 16, 1995

[54] MANUFACTURE OF BULK BAGS

[75] Inventor: Peter J. Nattrass, Barrington Hills, Ill.

[73] Assignee: Bulk Lift International Incorporated, Carpentersville, Ill.

[21] Appl. No.: 115,113

[22] Filed: Sep. 2, 1993

[51] Int. Cl.[6] ..... B31B 29/68; B31B 41/86

[52] U.S. Cl. ..... 493/226; 493/926

[58] Field of Search ..... 493/88, 89, 210, 226, 493/926

[56] References Cited

U.S. PATENT DOCUMENTS

| | | | |
|---|---|---|---|
| 4,010,784 | 3/1977 | Nattrass et al. . | |
| 4,307,764 | 11/1986 | Nattrass . | |
| 4,362,199 | 12/1982 | Futerman . | |
| 4,457,456 | 7/1984 | Derby et al. . | |
| 4,479,243 | 10/1984 | Derby et al. | 383/24 |
| 4,493,109 | 1/1985 | Nattrass | 493/226 |
| 4,610,028 | 9/1986 | Nattrass . | |
| 4,646,357 | 2/1987 | Nattrass . | |
| 4,822,179 | 4/1989 | Nattrass . | |
| 5,074,833 | 12/1991 | Futerman | 493/226 |
| 5,108,196 | 4/1992 | Hughes . | |
| 5,244,280 | 9/1993 | Porter et al. | 383/17 |

FOREIGN PATENT DOCUMENTS

| | | | |
|---|---|---|---|
| 2042469 | 9/1980 | United Kingdom | 493/926 |
| 2,130,172 | 5/1984 | United Kingdom . | |
| 2,132,171 | 7/1984 | United Kingdom . | |

*Primary Examiner*—William E. Terrell

*Attorney, Agent, or Firm*—Dorn, McEachran, Jambor & Keating

[57] ABSTRACT

A method of manufacturing a bulk bag having a side wall height H of at least about twenty inches (51 cm) and a total circumferential length L of at least about ninety inches (228 cm) comprises fabricating a fabric side wall structure having a height H and a total circumferential length L, and providing a plurality of lift loops each having a first and second leg portion. The legs of each lift loop are aligned at spaced locations around the top of the side wall structure, in positions for ready penetration by the tines of a forklift truck, with both leg portions of each lift loop extending a given distance downwardly from the top edge of the side wall structure. The leg portions of each of the lift loops are stitched to the top of the side wall structure by at least three parallel lines of high-strength thread, preferably by chain stitching or lock stitching. The stitching lines are all sewn in one or at most two passes; they extend horizontally across the lift loop legs to anchor the lift loops securely to the top of the side wall structure. There is no horizontal fold of the top of the side wall structure extending down to the anchor stitching.

17 Claims, 4 Drawing Sheets

MANUFACTURE OF BULK BAGS

BACKGROUND OF THE INVENTION

The use of large fabric bags for transporting semi-bulk quantities of powdered or granular material, bags which can be lifted only by forklift trucks, cranes, or other forms of material handling equipment having hooks or tines, is prevalent. Technically, such bags are known as FIBCs, for "Flexible Intermediate Bulk Containers"; in the industry, they are also known as "bulk bags" and are referred to as such in this specification. The size of a bulk bag may vary substantially, depending upon the density and other characteristics of the material transported, the rated weight capacity of the bulk bag, and other factors. In general, a bulk bag usually has a height substantially exceeding twenty inches (51 cm) and a periphery of more than ninety inches (228 cm). A bulk bag is most often square in cross section, but it may be round or of other cross-sectional configuration.

Early bulk bags are shown in U.S. Pat. No. 4,010,784 of Frank and Peter Nattrass; those bulk bags have four lifting loops attached to the top corners of the bag. The fabric at the top of each corner of the bag is folded into a substantially S-shaped configuration to provide three overlying layers of fabric, and a leg of each lifting loop is inserted between two of the three layers. The resulting assembly is stitched together to secure each lifting loop to the top of the bag. This construction is relatively strong and was commercially successful, but had the disadvantage that the top of the bag was smaller than the lower part of the bag.

Another bulk bag construction, in commercial use in the United States since 1980, is disclosed in U.S. Pat. No. 4,307,764 to Peter Nattrass. That bulk bag utilizes three rectangular fabric members; one forms two sides and the bottom of the bag, whereas the other two members form opposed sides of the bulk bag. Each of these three members has two side edges folded over, affording two upwardly open pockets at each corner of the bulk bag. The legs of the lifting loops are usually inserted into the tops of the two pockets of side wall fabric at each corner of the bag and then sewn in place by multiple lines of stitching. Criss-cross stitching over the height of the lifting loop legs is the preferred construction but other sewing variations have been employed.

Another known bulk bag construction, described in Futerman U.S. Pat. No. 4,362,199, has spread lifting loops at each corner of the top of the bag and utilizes reinforced vertical bands in the side walls of the bag; one of the reinforced bands is aligned with each lifting loop leg. The individual lifting loops are separately stitched to the top of the bag, usually by box stitching. In the preferred construction the top of each side wall is folded over so that two layers of side wall fabric are joined to each lifting loop leg. A variation of this construction is included in Derby et al. U.S. Pat. No. 4,457,456, in which the lifting loops are formed from a continuous length of webbing that extends around the top of the bag; that webbing forms a series of V-shaped projections, one above the top portion of each side wall of the bag. Again, the top of the bag is usually folded over to provide a double layer. A somewhat similar construction is shown in Peter Nattrass U.S. Pat. No. 4,646,357; it employs individual lift loops having their legs spread out across each corner of the bag. The top of the bag is folded over to form a double horizontal layer into which the leg portions of each lift loop are sewn.

Another bulk bag construction is shown in Peter Nattrass U.S. Pat. No. 4,822,179. In the bulk bags shown in that patent, the lifting loops are formed of multiple layers of the same fabric as used in constructing the body of the bulk bag. Anchoring of these lifting loops to the top of the bag is provided by multiple stitching in patterns preferably similar to those in the earlier U.S. Pat. No. 4,307,764.

In a more recent patent, Hughes U.S. No. 5,108,196, the top of a bulk bag is folded over to afford a double layer at the top of the bag side wall. Indeed, a triple layer is described as preferred. In the bulk bags shown in this patent, the leg portions of the lifting loops are aligned with reinforced bands in the side walls of the bag. The lifting loops themselves are secured to the top of the bag by chain stitching that extends around the entire top periphery of the bag, with the lifting loops being anchored into the horizontally folded portion of the bag top. A related construction, but with lifting loops individually attached to the reinforcing strips, is described in the British Patent Publication No. 2 132 171 of S. Hartman. In another bulk bag construction, in F. Nattrass U.S. Pat. No. 4,610,028, the lifting loops are formed as integral extensions of reinforced portions of the side walls of the bulk bag.

A common concept, incorporated in many previously known bulk bags, is that the anchoring of lift loops to plural layers of side wall fabric is desirable to increase the overall strength of the bulk bag when subjected to the various tests utilized in the industry, particularly those tests that are aimed at determining the lifting capacity of the bulk bag; a 5:1 ratio of actual capacity to rated capacity is considered standard. Another prevalent concept, present in some known bags but not in all of them, is that when individual lift loops are utilized they should be anchored to the side wall fabric by individual stitching, either by box stitching or by multiple lines of stitching extending across both legs of a lift loop. The end result of adherence to these two concepts has been and is a relatively high cost of construction for the bulk bags. That high cost arises from two sources: the labor involved in individual stitching of lift loops to side walls and the excess fabric used in the side walls. The labor cost predominates. The present invention is based upon the discovery that these costs can both be materially reduced without appreciable loss of strength in the finished product. In practice, a reduction in labor cost by a factor of four to eight or more is achieved. Thus, it has been ascertained that bulk bags can be constructed with a major reduction in cost while maintaining high standards of strength for the finished bulk bags by utilizing the present invention.

SUMMARY OF THE INVENTION

It is a principal object of the invention, therefore, to provide a new and improved method of manufacture and construction for a bulk bag that materially reduces the cost of manufacture for the bulk bag with little or no loss of strength in the completed bulk bag as compared with a bulk bag utilizing more conventional construction techniques.

A specific object of the invention is to provide a new and improved method of manufacture and construction for a bulk bag that minimizes the quantity of side wall fabric employed in the bulk bag and that greatly reduces the amount of labor employed to anchor individual lifting loops to the bulk bag, all without appreciable loss of strength in the finished product.

Accordingly, in one aspect the invention relates to the method of manufacturing a bulk bag having a side wall height H of at least about twenty inches (51 cm) and a total circumferential length L of at least about ninety inches (228 cm). The method comprises the following steps:

A. fabricating a flexible fabric side wall structure for a bulk bag body, sans lifting straps, the side wall structure having a height H between a top edge and a bottom edge and having a total circumferential length L;

B. providing a plurality of N lift loop straps, each lift loop strap comprising a continuous strap having first and second leg portions interconnected by a lift loop portion;

C. aligning the legs of each lift loop strap of step B at one of a series of N spaced locations around the top of the bulk bag side wall structure of step A, with both leg portions of each lift loop strap extending a given distance downwardly from the top edge of the bulk bag side wall structure; and D. stitching the leg portions of each of the lift loop straps to the top of the bulk bag side wall structure with a plurality of at least three lines of stitching of high-strength thread, the stitching lines extending transversely across the lift loop strap leg portions of all of the lift loop straps in a horizontal direction, parallel to the top edge of the bulk bag side wall structure, thereby anchoring all of the lift loop straps to the top of the side wall structure;

all of steps A–D being carried out so that the uppermost line of anchor stitching is located below any horizontal fold in the top of the side wall structure.

In another aspect, the invention relates to a bulk bag comprising a bulk bag body assembly fabricated of a flexible woven fabric, the body assembly including a bottom wall having a total circumferential length of at least about ninety inches (228 cm) and a closed side wall structure having a height of at least about twenty inches (51 cm) between a bottom edge and a top edge, the bottom edge of the side wall structure being joined to the periphery of the bottom wall. The bulk bag further comprises a plurality of lift loop straps, each comprising a continuous fabric strap having first and second leg portions interconnected by a lift loop portion, located at spaced intervals around the top of the bulk bag body assembly, with both leg portions of each lift loop strap extending a given distance downwardly from the top edge of the side wall structure. A plurality of at least three lines of stitching of high-strength thread are present in the top portion of the side wall structure, the stitching lines extending horizontally parallel to each other completely around the top of the sidewall structure and anchoring the leg portions of all of the lift loop straps to the top of the side wall structure; the topmost line of anchor stitching is located a distance D below the top edge of the sidewall structure, the distance D being very much smaller than the height of the sidewall structure. There is no horizontal fold, in the top end of the side wall structure, having a height as large as the distance D.

DESCRIPTION OF THE PREFERRED EMBODIMENTS

Figure 1:
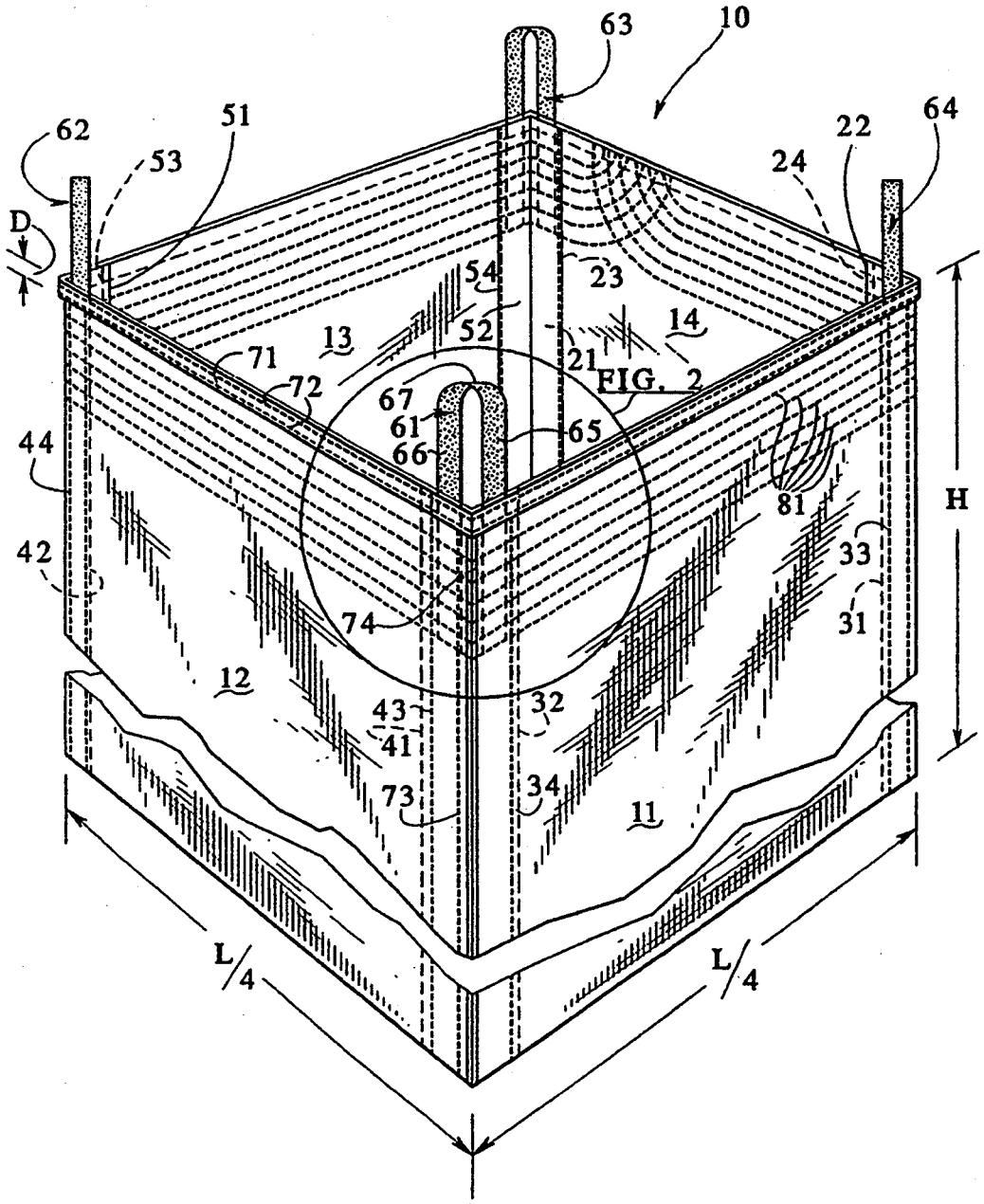
FIG. 1 is a perspective view of a bulk bag constructed in accordance with one embodiment of the invention.

FIG. 1 illustrates a bulk bag 10 constructed in accordance with a first embodiment of the present invention and in accordance with a method that itself constitutes an embodiment of the invention. Bulk bag 10 comprises a flexible fabric side wall structure that includes four side wall panels 11,12,13, and 14; panels 11–14 are joined to each other at the corners of bulk bag 10. The first side wall panel 11 has an overall height H between the top edge and the bottom edge of panel 11. That height H constitutes the overall height of bulk bag 10 and is the same for all of the other side wall panels 12,13 and 14. There is no horizontal fold at the top of bulk bag 10. The width of the side wall panel 11, assuming that bulk bag 10 is approximately square in cross-section, is L/4. Again, the widths of the other panels 12,13 and 14 are approximately the same so that the total circumferential length for bulk bag 10 is equal to L. For most bulk bags, the side wall height H is at least about twenty inches (51 cm); more frequently, that height is in a range of thirty-six to seventy-two inches (91 to 180 cm). The circumferential length L for bag 10 should be at least about ninety inches (228 cm). Perhaps the most common total length L for a bulk bag is approximately one hundred forty inches, with the width of each side wall, L/4, being approximately thirty-five inches (89 cm).

Figure 2:
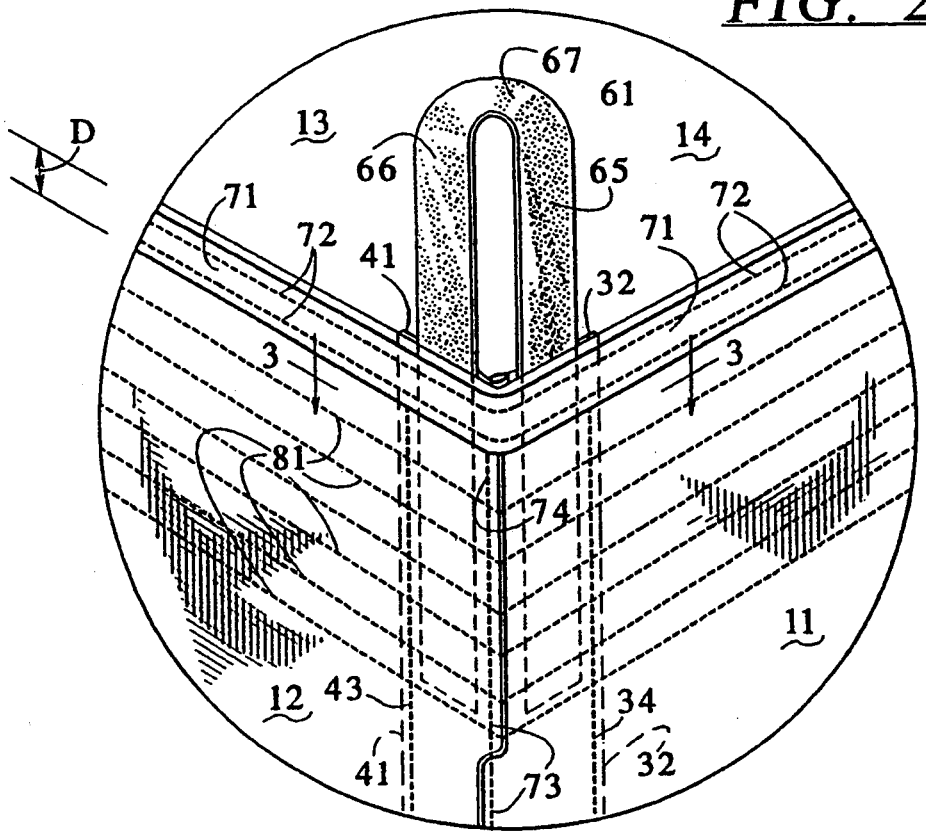
FIG. 2 is a detail view, on an enlarged scale, of one top corner of the bulk bag of FIG. 1, the corner enclosed within the circle 2 of FIG. 1.
Figure 3:
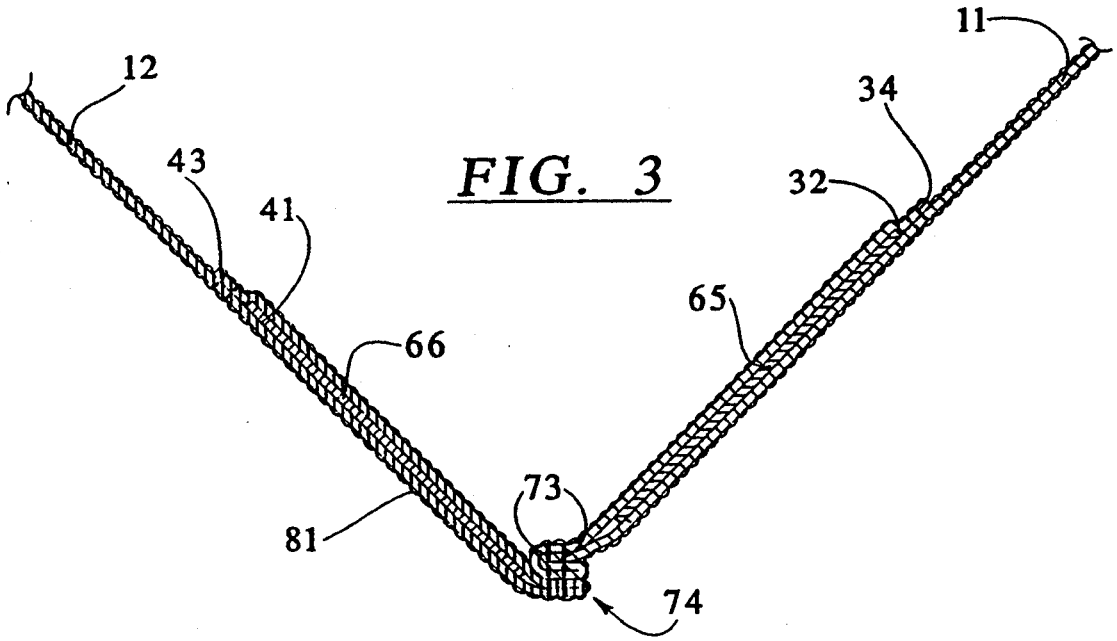
FIG. 3 is a sectional view taken approximately as indicated by line 3—3 in FIG. 2, on a further enlarged scale.

Bulk bag 10, FIGS. 1–3, utilizes many of the structural features of the highly successful commercial bag of Nattrass U.S. Pat. No. 4,307,764. Thus, the two vertical side edges of bag panel 14 are folded over to provide individual vertical hems or pockets 21 and 22. Those hems may be stitched vertically by lines of stitching 23 and 24. On the other hand, the stitching 23 and 24 may be omitted if desired. The same construction is utilized for each of the other panels 11,12 and 13. Thus, panel 11 has two vertical side pockets 31 and 32 which may be secured to the rest of the panel by vertical stitching 33 and 34. Panel 12 has vertical hems 41 and 42 that may be held down by stitching lines 43 and 44, respectively. Bag panel 13 has a vertical pocket 51 that may be secured by vertical stitching 53, and, at its opposite side, a vertical pocket 52 secured by stitching 54.

Bulk bag 10 is provided with four lift loop straps 61,62,63 and 64. Lift loop strap 61 bridges the corner between side walls 11 and 12 at the top of bag 10. Loop 62 is located at the top corner of panels 12 and 13. Lift loop strap 63 goes across the top of the corner between panels 13 and 14. The fourth lift loop strap 64 extends across the top of the corner between side wall panels 11 and 14. Lift loop strap 61 is a continuous strap, which may be formed of webbing or like strong material or may be made of plural layers of side wall fabric as in U.S. Pat. No. 4,822,179. A typical width for strap 61 is about two inches (five cm) when webbing is employed. Loop strap 61 has first and second leg portions 65 and 66 connected by a lift portion 67. Leg portion 65 of strap 61 extends downwardly into the hem or pocket 32 of panel 11, as best shown in FIGS. 2 and 3. The other leg 66 of strap 61 extends downwardly a given distance from the top edge of the bulk bag side wall structure into the vertical pocket 41 of panel 12.

A safety band 71, usually webbing, extends around the periphery of the top end of the side wall structure comprising panels 11–14. The safety band 71 is sewn to the top of the bag structure by appropriate stitching 72; one line of band stitching 72 may be adequate but two lines of stitching may be utilized if preferred. The bottom and the top of bulk bag 10 should each be closed off by further bottom and top panels (not shown). The bottom panel may be a continuation of two of the side panels, such as panels 11 and 13, utilizing the construction most commonly employed in current commercial bags. The lift loop straps at the other corners of bag 10, straps 62–64, are all disposed in the vertical hems or pockets of the side wall panels of the bag in the same manner as described in detail for strap 61. If preferred, the lift loop strap portions may be positioned externally of the side wall panel hems, on the inside or outside of bulk bag 10.

FIGS. 2 and 3 illustrate a typical corner construction for bulk bag 10 of FIG. 1. The fold edges of the vertical pockets or hems 41 and 32 are shown sewn together throughout the height of the bag, as by one or more lines of stitching 73. At the top of the bag the two fold edges are further folded together at 74 to fit beneath safety band 71; see FIG. 2.

As thus far described, bulk bag 10 corresponds generally to the construction shown in the prior commercial construction of U.S. Pat. No. 4,307,764. The principal difference is in the manner in which the lift loop straps 61–64 (FIG. 1) are anchored to the side wall structure of the bulk bag body, comprising the side wall panels 11–14. The anchoring of the lift loop straps to the top end of the bulk bag side wall structure is accomplished by a plurality of parallel lines of anchor stitching 81, preferably chain stitching or lock stitching, beginning a short distance D below the top edge of the bulk bag. The spacing between stitching lines 81 is preferably about one inch (2.5 cm) or less. Each of these lines of stitching 81 extends completely around the top of the bag's body structure, across all of the leg portions of the lift loop straps 61–64 in a horizontal direction, parallel to the top edge of the side walls. In FIGS. 1 and 2 six equally-spaced lines of anchor stitching 81 are shown. Typically, this would be the number of lines of stitching required to anchor the lift loops to a bulk bag having a rated capacity of two metric tons. As few as three rows of chain stitching 81 may be sufficient for a bulk bag having a rated capacity of only one metric ton. On the other hand, for a substantially larger bulk bag, with a rated capacity of three metric tons or more, as many as eight rows of stitching of high-strength thread may be required for the anchor stitching 81.

The preferred fabric for side wall panels 11–14 is a plain woven fabric, with polypropylene tape used as the yarn for the weave in both the warp and the weft. The preferred thread for the stitching 81 that anchors lift loop straps 61–64 to the top of bulk bag 10 is a polyester or polypropylene filament thread having a minimum tensile strength of eighty pounds. On the other hand, even stronger thread may be employed for the anchor stitching, up to at least one hundred twenty-five pounds tensile strength. The thread for stitching 81 preferably should have an overall size of between 3,000 and 6,000 denier or more.

Bulk bag 10 is constructed on a basis contrary to conventional concepts. To begin with, there is no individual anchoring of the lift loop straps 61–64 to the top of the bulk bag. That is, the individual multiple stitching operations usually employed in anchoring lift loop straps to the top of a bulk bag are not employed. At the same time, moreover, there is no horizontal fold in the top of the side wall structure comprising panels 11–14. Thus, in bulk bag 10 there is no excess side panel fabric as would be required for such a horizontal fold. This could be expected to reduce the overall strength of bulk bag 10, according to conventional wisdom; in actual fact, bulk bag 10 is not weakened, and, if anything, is stronger than prior constructions.

Figure 4:
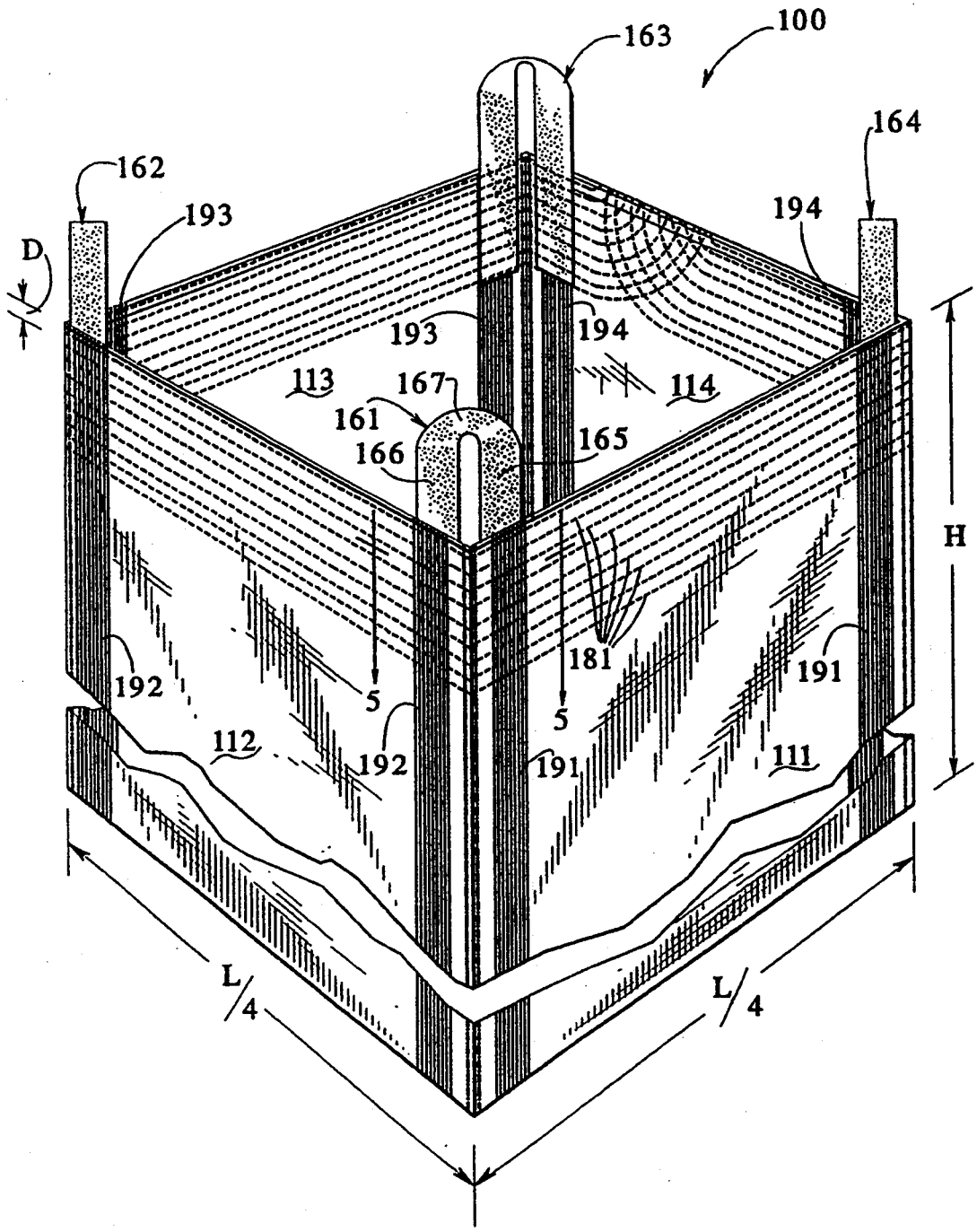
FIG. 4 is a perspective view, similar to FIG. 1, of a bulk bag constructed in accordance with a further embodiment of the invention.
Figure 5:
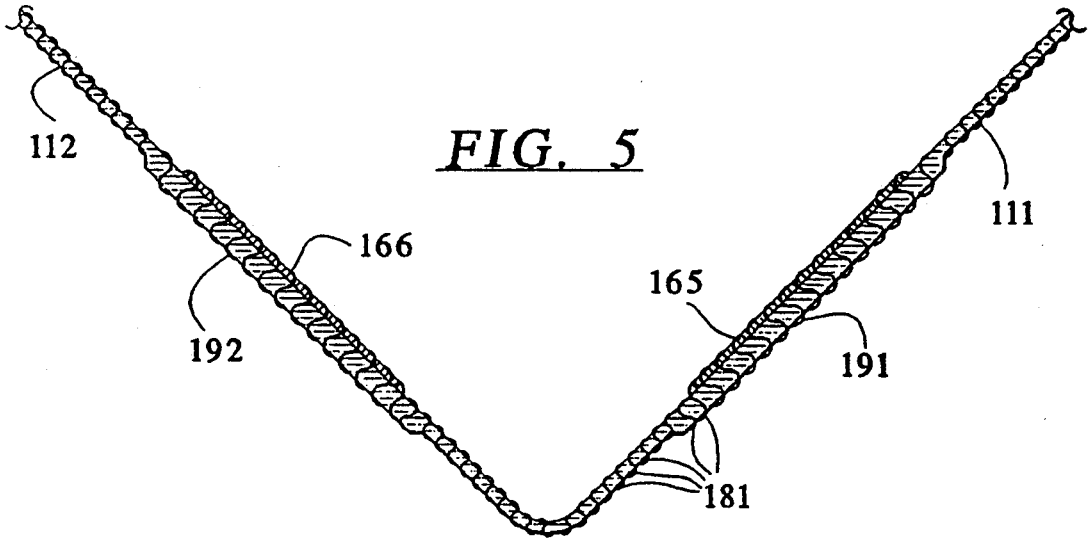
FIG. 5 is a sectional view, similar to FIG. 3, of a corner of the bulk bag of FIG. 4.

FIGS. 4 and 5 illustrate a bulk bag 100 constructed in accordance with another embodiment of the present invention and in accordance with the method of the invention. Bulk bag 100 comprises a flexible fabric side wall structure that includes four side wall panels 111,112,113, and 114; panels 111–114 are continuous with each other at the corners of bulk bag 100. The first side wall panel 111 has an overall height H between the top edge and the bottom edge of the panel. Height H constitutes the overall height of bulk bag 100 and is the same for all of the other side wall panels 112,113 and 114 because the entire side wall structure of bulk bag 100 is cut from a continuous length of tubular fabric. The width of side wall panel 111, assuming that bulk bag 100 is approximately square in cross-section, is L/4. Again, the widths of the other panels 112,113 and 114 are approximately the same. Bag 100 has a square shape only because it includes a square bottom wall (not shown). It could easily be round in cross sectional configuration; the square shape is preferable for commercial purposes. Thus, the total circumferential length for bulk bag 100 is equal to L, as before. The side wall height H is at least about twenty inches (51 cm); more frequently, that height is in a range of thirty-six to seventy-two inches (90 to 180 cm). The circumferential length L for bag 100 should be at least about ninety inches (228 cm). Perhaps the most common total length L for bulk bag 100 is approximately one hundred forty inches, with the width of each side wall, L/4, being approximately thirty-five inches (89 cm).

Bulk bag 100, FIG. 4, is provided with four lift loop straps 161–164. Lift loop strap 161 bridges the corner between side walls 11 and 12 at the top of bulk bag 100 but its leg portions are spread considerably as compared with bulk bag 10 of FIG. 1. Loop 162 is located at the top corner of panels 12 and 13. Lift loop strap 163 goes across the top of the corner between panels 113 and 114. The fourth lift loop strap 164 extends across the top of the corner between side wall panels 111 and 114. As in the previous embodiment, lift loop strap 161 is a continuous strap, which may be formed of webbing or like strong material or may be made of plural layers of side wall fabric as in U.S. Pat. No. 4,822,179. If a plural layer lift loop construction is used, the width may be four inches (10 cm) or more. Loop strap 161 has first and second leg portions 165 and 166 connected by a lift portion 167. Leg portion 165 of strap 161 extends downwardly in alignment with the top portion of side wall panel 111, as best shown in FIGS. 1 and 5. The other leg portion 166 of strap 161 extends downwardly a given distance from the top edge of the bulk bag side wall structure in alignment with panel 112.

This is no safety band around the periphery of the top of the side wall structure 111–114 of bulk bag 100. Instead, there is a very short fold 171, having a height, less than the distance D, of about one inch (2.5 cm) or less around the top of the bag structure. Fold 171 is sewn down by an appropriate line of stitching 172; two lines of the retention stitching 172 may be utilized if preferred. Fold 171 serves to preclude ravelling of the top edge of the side wall structure, panels 111–114. Of course, the bottom and the top of bulk bag 100 would be closed off by further rectangular panels (not shown).

Figure 6:
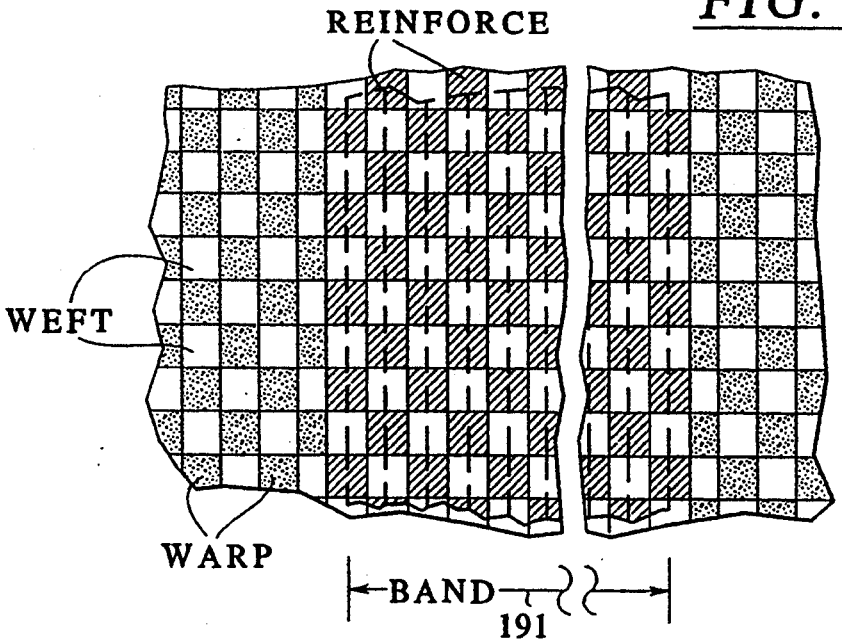
FIG. 6 is a greatly enlarged illustration of a portion of a reinforced band in the bulk bag of FIGS. 4 and 5.

The tubular fabric for bulk bag 100 from which the side wall structure comprising panels 111–114 is cut is not of uniform consistency. It includes a plurality of reinforcement bands each extending vertically (longitudinally of the tubing from which the side wall structure is cut) and hence parallel to the axis of the tube. There are two such reinforcement bands 191 in panel 111, two reinforcement bands 192 in panel 112, two reinforcement bands 193 in panel 113, and two more such reinforcement bands 194 in panel 114. Thus, in bulk bag 100, where there are four lift loops 163–164, there are eight reinforcement bands 191–194. Stated differently, for N lift loop straps (N=4 in bulk bag 100) there are 2N reinforcement bands. Moreover, each leg portion of each lift loop strap 161–164 is aligned with one of the reinforcement bands 191–194, as clearly shown in FIGS. 4 and 5. A preferred weave for any of the reinforcement bands is shown in FIG. 6.

In bulk bag 100 the anchoring of the lift loop straps 161–164 to the top end of the bulk bag side wall structure is again accomplished by a plurality of lines of anchor stitching, preferably chain stitching or lock stitching, of high-strength thread, shown as stitching lines 181. Each of these lines of stitching 181 extends completely around the top of the bag's body structure, across all of the leg portions of the lift loop straps 161–164 in a horizontal direction, parallel to the top edge of the side walls 111–114. In FIG. 4 eight lines of anchor stitching 181 are shown; preferably, the lines of stitching 181 are equally spaced from each other, with the spacing between lines no greater than one inch (2.5 cm). Typically, this would be the number of lines of anchor stitching for a bulk bag having a rated capacity of three metric tons or more. As in the previously described embodiment, three rows of stitching 181 may be sufficient for a bulk bag having a rated capacity of only one metric ton.

The preferred fabric for the tubing from which the side wall structure comprising the side wall panels 111–114 is cut is again a plain woven fabric, with polypropylene tape used as the yarn for both the weft and the warp in the weave. The preferred thread for the stitching 181 that anchors lift loop straps 161–164 to the top of bulk bag 100 is a polyester or polypropylene filament thread having a minimum tensile strength of eighty pounds. On the other hand, even stronger thread may be employed for the anchor stitching, up to at least one hundred twenty-five pounds tensile strength. The thread preferably should have an overall size of between 3,000 and 6,000 denier or more.

Bulk bag 100 (FIGS. 4 and 5) shares its basic construction with the bulk bag 10 of FIGS. 1–3. There is no individual anchoring of the lift loop straps 161–164 to the top of the bulk bag side wall structure comprising panels 111–114. That is, the individual multiple stitching operations usually employed in anchoring lift loop straps to the top of a bulk bag are not utilized. There is no horizontal fold in the top of the side wall structure comprising panels 111–114, in the part of the side wall structure where the anchoring lines of stitching 181 are present. Thus, in bulk bag 100 there is no wasted side panel fabric. While this might be expected to reduce the overall strength of bulk bag 100, in actual fact the bulk bag is not weakened and, if anything, is stronger than prior constructions.

The basic method of manufacture for both of the bulk bags described above (bulk bag 10 of FIGS. 1–3 and bulk bag 100 of FIGS. 4 and 5) is much the same. That method involves the following steps:

A. Fabricating a flexible fabric side wall structure for a bulk bag body, sans lifting straps, the side wall structure having a height H between a top edge and a bottom edge and having a total circumferential length L. For bulk bag 10 this is the side wall structure comprising panels 11–14; in bulk bag 100 it is the segment of woven tubing constituting panels 112–114.

B. Providing a plurality of N lift loop straps, each lift loop strap comprising a continuous strap having first and second leg portions interconnected by a lift loop portion. In both illustrated bulk bags N=4; N=2 and N=6 may be used.

C. Aligning the legs of each lift loop strap of step B at one of a series of N spaced locations around the top of the bulk bag side wall structure of step A, with both leg portions of each lift loop strap extending a given distance downwardly from the top edge of the bulk bag side wall structure. In each of the bulk bags 10 and 100, FIGS. 1 and 4, these locations are at the bag corners; they could be at other locations such as the centers of the side wall panels.

D. Stitching the leg portions of each of the lift loop straps to the top of the bulk bag side wall structure with a plurality of at least three lines of stitching of high-strength thread; in bag 10 (FIG. 1) these are the stitching lines 81, whereas in bag 100 (FIG. 4) they are the stitching lines 181. Chain and lock stitching is preferred. The anchor stitching lines are sewn so as to extend horizontally across the leg portions of all of the lift loop straps, parallel to the top edge of the bulk bag side wall structure. Thus, all of the lift loop straps are anchored to the top of the side wall structure by the plural lines of stitching of high-strength thread. In both, polyester or polyethylene thread is preferred for the anchor stitching; equally spaced stitching lines are preferred.

In both bulk bags, all of the foregoing steps A–D are carried out so that the uppermost line of anchor stitching is located below any horizontal fold in the top of the side wall structure. Bulk bag 10 (FIG. 1) has no horizontal fold; bulk bag 100 (FIG. 4) has only the short fold 171 that is less than D in height and hence does not extend down to the uppermost stitching line 181.

From this common base of method steps, divergences occur. Thus, in the manufacture of bulk bag 100, FIGS. 4 and 5, a plurality of 2N reinforcement bands 191–194 (N=number of lift straps) are woven into the side wall panels 111–114, with each reinforcement band vertical so that it is parallel to the axis of the bulk bag. To be effective, this variation of the basic manufacturing method requires aligning each leg portion of each lift loop strap (161–164) with one reinforcement band (191–194) in the bag side wall structure. Thus, each lift loop strap leg portion is anchored to and constitutes a continuation of a reinforcement band. Similar reinforcement bands can be incorporated in a side wall structure using separate panels, like that employed in the bulk bag 10 of FIGS. 1. In all cases, it is preferred that the reinforcement bands be wider than the lift loop strap legs. In either type of bulk bag, or in any similar bulk bag, if reinforcement bands are utilized they are preferably formed by weaving a plurality of additional vertical yarns into the side wall fabric, with those vertical yarns constituting tapes of the same resin as is used in the portions of the bulk bag side wall panels intermediate the reinforcement bands. Indeed, it is preferred that the reinforcing yarns (or tapes) be the same as those used to weave the basic side wall fabric. The reinforcement band construction is illustrated in FIG. 6.

Both of the bulk bags 10 and 100 are strong and durable, and each can readily be constructed to meet all of the industry requirements and tests imposed on FIBCs. That is equally true with respect to bulk bags that combine or vary the basic features of the two.

In manufacture of any such bulk bag it is desirable to limit the number of sewing operations as much as possible, particularly in the stage of manufacture in which the lift loop straps are sewn to the body structure by means of the anchor stitching 81 or 181. The best manufacturing procedure is to apply the anchor stitching with a sewing machine assembly incorporating four simultaneously operable sewing heads. If only three lines of anchor stitching are required to meet the weight capacity requirements of the bulk bag, the thread and needle should be omitted from one sewing head. For four anchor stitching lines, all sewing heads are equipped with needles and supplied with thread. In either case a single sewing operation around the top of the bulk bag body anchors all lifting loop straps in place, a major reduction in assembly labor as compared with conventional techniques. In fact, the overall reduction in labor in manufacture of the bulk bag is readily reduced by a factor of four or more; the reduction may equal or exceed a factor of eight. For bulk bags requiring six or eight lines of anchor stitching, two sewing passes around the bag body top may be needed; there is still a substantial reduction in labor costs.

I claim:

1. The method of manufacturing a bulk bag having a side wall height H of at least about twenty inches (51 cm) and a total circumferential length L of at least about ninety inches (228 cm), the method comprising the following steps:

A. fabricating a flexible fabric side wall structure for a bulk bag body, sans lifting straps, the side wall structure having a height H between a top edge and a bottom edge and having a total circumferential length L;

B. providing a plurality of N lift loop straps, each lift loop strap comprising a continuous strap having first and second leg portions interconnected by a lift loop portion;

C. aligning the legs of each lift loop strap of step B at one of a series of N spaced locations around the top of the bulk bag side wall structure of step A, with both leg portions of each lift loop strap extending a given distance downwardly from the top edge of the bulk bag side wall structure; and D. stitching the leg portions of each of the lift loop straps to the top end of the bulk bag side wall structure with a plurality of at least three lines of anchor stitching of high-strength thread, the anchor stitching lines each extending transversely across the lift loop strap leg portions of the lift loop straps in a horizontal direction, parallel to the top edge of the bulk bag side wall structure, thereby anchoring all of the lift loop straps to the top of the side wall structure;

all of steps A–D being carried out so that the uppermost line of anchor stitching is located below any horizontal fold in the top of the side wall structure.

2. The method of manufacturing a bulk bag, according to claim 1, in which step A is carried out by:

A1. providing an elongated body tubing of fabric, woven from resin yarn, having a circumference L; and A2. severing a bag tube side wall structure segment from the body tubing of step A1, transversely of the axis of the tubing, the bag tube side wall segment having a height approximately equal to H between the top edge and the bottom edge of the bag tube side wall structure segment.

3. The method of manufacturing a bulk bag, according to claim 2, comprising the following additional steps:

A3. in step A1, incorporating a plurality of 2N reinforcement bands in the body tubing, with each reinforcement band extending longitudinally of the body tubing parallel to the axis of that tubing; and C1. in step C, aligning each leg portion of each lift loop strap with one reinforcement band in the bag tube side wall segment so that the lift loop strap leg portion is anchored to and constitutes a continuation of the reinforcement band.

4. The method of manufacturing a bulk bag, according to claim 3, in which each reinforcement band of step A3 is wider than the lift loop strap leg portions aligned therewith in step C1.

5. The method of manufacturing a bulk bag, according to claim 4, in which, in step D, the lines of anchor stitching are maintained equally spaced from each other and the spacing between lines of anchor stitching is no greater than about one inch (2.5 cm).

6. The method of manufacturing a bulk bag, according to claim 3, in which each reinforcement band in the body tubing, step A3, is formed by a plurality of additional yarns, parallel to the axis of the tubing, woven into the warp of the tubing, and in which the additional yarns are of the same resin and have the same tensile strength as the yarns used in the portions of the body tubing intermediate the reinforcement bands.

7. The method of manufacturing a bulk bag, according to claim 6, in which, in step D, the lines of anchor stitching are maintained equally spaced from each other and the spacing between lines of anchor stitching is no greater than about one inch (2.5 cm).

8. The method of manufacturing a bulk bag, according to claim 1, in which the thread for the anchor stitching of step D is a polyester or polypropylene resin thread that has a size of at least three thousand denier.

9. The method of manufacturing a bulk bag, according to claim 8, comprising the following additional steps:

A4. in step A, incorporating a plurality of 2N reinforcement bands in the bulk bag body structure, with each reinforcement band extending vertically of the bulk bag body structure from its top end to its bottom end; and C2. in step C, aligning each leg portion of each lift loop strap with one reinforcement band at the top end of the bulk bag body structure segment so that the lift loop strap leg portion is anchored to and constitutes a continuation of the reinforcement band.

10. The method of manufacturing a bulk bag, according to claim 9, in which each reinforcement band of step A4 is wider than the lift loop strap leg portions aligned therewith in step C2.

11. The method of manufacturing a bulk bag, according to claim 9, in which each reinforcement band, in step A4, is formed by a plurality of additional warp yarns woven into the side wall fabric, and in which the additional yarns are of the same resin and have the same tensile strength as the yarns used in the portions of the bulk bag body tubing intermediate the reinforcement bands.

12. The method of manufacturing a bulk bag, according to claim 11, in which, in step D, the lines of anchor stitching are maintained equally spaced from each other and the spacing between lines of anchor stitching is no greater than about one inch (2.5 cm).

13. The method of manufacturing a bulk bag, according to claim 1, in which step A is carried out by:

A5. providing a plurality of bulk bag body side wall panels of fabric woven from resin yarn; and A6. joining the side wall panels of step A5 together to form a bulk bag side wall structure having a height H between the top edge and the bottom edge of the structure and having a total circumferential length L.

14. The method of manufacturing a bulk bag, according to claim 13, comprising the following additional steps:

A7. in step A5, incorporating a plurality of 2N reinforcement bands in the bulk bag body side wall panels, with each reinforcement band extending vertically of the bulk bag body from its top end to its bottom end; and C3. in step C, aligning each leg portion of each lift loop strap with one reinforcement band at the top end of the bulk bag body structure so that the lift loop strap leg portion is anchored to and constitutes a continuation of the reinforcement band.

15. The method of manufacturing a bulk bag, according to claim 14, in which each reinforcement band of step A7 is wider than the lift loop strap leg portions aligned therewith in step C3.

16. The method of manufacturing a bulk bag, according to claim 14, in which each reinforcement band in the bulk bag side wall panels, step A7, is formed by a plurality of additional vertical yarns woven into the sidewall fabric, and in which the additional yarns are of the same resin and have the same tensile strength as the yarns used in the portions of the bulk bag side wall panels intermediate the reinforcement bands.

17. The method of manufacturing a bulk bag, according to claim 16, in which, in step D, the lines of anchor stitching are maintained equally spaced from each other and the spacing between lines of anchor stitching is no greater than about one inch (2.5 cm).

* * * * *